US007093904B1

(12) United States Patent
McMillen

(10) Patent No.: US 7,093,904 B1
(45) Date of Patent: Aug. 22, 2006

(54) CHAIR WITH FOLD-DOWN ARMS FOR PROVIDING ADDITIONAL SEATING

(76) Inventor: Carl McMillen, 26002 Andrea Ct., Mission Viejo, CA (US) 92691

( * ) Notice: Subject to any disclaimer, the term of this patent is extended or adjusted under 35 U.S.C. 154(b) by 0 days.

(21) Appl. No.: 11/214,184

(22) Filed: Aug. 29, 2005

(51) Int. Cl.
*A47C 7/54* (2006.01)

(52) U.S. Cl. ..... 297/411.37; 297/411.32; 297/411.34

(58) Field of Classification Search ..... 297/411.3, 297/411.32, 411.34, 452.4, 115, 116, 411.37
See application file for complete search history.

(56) References Cited

U.S. PATENT DOCUMENTS

| | | | | | |
|---|---|---|---|---|---|
| 137,062 | A | | 3/1873 | Croghan | |
| 156,177 | A | * | 10/1874 | Schaebel et al. | 297/116 |
| 259,642 | A | * | 6/1882 | Hofstatter, Jr. | 297/116 |
| 352,723 | A | | 11/1886 | Weeden | |
| 583,136 | A | | 5/1897 | Anderson | |
| 863,874 | A | * | 8/1907 | Rajner | 297/115 |
| 961,169 | A | | 6/1910 | Shear | |
| 1,335,973 | A | | 4/1920 | Kesselman | |
| 1,922,502 | A | * | 8/1933 | Scragg | 297/116 |
| 2,035,452 | A | * | 3/1936 | Bell | 297/116 |
| 2,053,349 | A | * | 9/1936 | Nordmark | 297/116 |
| 2,116,366 | A | | 5/1938 | Scott | |
| 2,621,708 | A | * | 12/1952 | Luce, Jr. | 297/117 |
| 2,790,485 | A | * | 4/1957 | Franklin | 297/116 |
| 4,155,588 | A | | 5/1979 | Danziger et al. | |
| 5,647,632 | A | | 7/1997 | Fireman | |
| 5,713,632 | A | * | 2/1998 | Su | 297/312 |
| 5,752,684 | A | * | 5/1998 | Larkin | 248/188.7 |
| 6,773,059 | B1 | | 8/2004 | Volotsenko | |

* cited by examiner

*Primary Examiner*—Laurie K. Cranmer
(74) *Attorney, Agent, or Firm*—QuickPatents.com; Kevin Prince

(57) ABSTRACT

A convertible chair is disclosed that has pivotable side cushions for pivoting between a lowered position and a raised position. A frame includes a generally horizontal seat, as well as a pair of pivot supports each fixed to a respective side of the seat. Two sets of bars are included, each bar being pivotably supported at one end thereof to one of the pivot supports and pivotably supported thereby. Each set of bars are fixed to and support one of the side cushions. In the lowered position the side cushions each provide additional seating area, whereas in the raised position an outer edge of the each cushion may be used as an armrest for a person sitting in the chair.

9 Claims, 3 Drawing Sheets

CHAIR WITH FOLD-DOWN ARMS FOR PROVIDING ADDITIONAL SEATING

FIELD OF THE INVENTION

This invention relates to chairs, and more particularly to a chair with fold-down arms to provide additional seating.

DISCUSSION OF RELATED ART

With the increased use of computers, video games and the like, it is often desirable to have two people sitting side-by-side to perform or learn a task. For example, a worker may wish to instruct a co-worker on how to use a particular software application, or siblings may wish to play together a particular video or computer game. Typically, in such situations, two chairs are brought together and placed abreast, one for each person. However, there are considerable drawbacks to such an arrangement. Often the chairs that are brought together must be considerably smaller than a conventional padded office chair, or the like, due to space constraints around the desk or other work environment. As a result, typically standard folding chairs are used, and such chairs are legendarily uncomfortable to use for extended periods of time. Further, the space required by two such chairs is still considerable, and often both parties must get up and move their chair if one is going to leave the area temporarily, for example, to get another video game cartridge or use a rest room, etc.

Several prior art devices are known to provide extra seating area with a chair. For example, U.S. Pat. No. 2,116,366 to Scott on May 3, 1938, provides a chair with a fold-out side chair arrangement. Such a device is designed for use on a bus or trolley, results in an unsightly appearance, and requires the user to take numerous steps to assembly the adjacent seat and to properly place a support footing. Further, such a device requires a floor bracket to be permanently mounted to the floor, a requirement unsuitable for most office or household use.

U.S. Pat. No. 2,621,708 to Luce, Jr., on Dec. 16, 1952 discloses a similar arrangement, wherein the additional side chair is formed as two halves, each half being fixed to a seat adjacent an aisle. Such an arrangement is particularly well-suited for use in a bus or other vehicle having an aisle wherein the seat may be configured for temporary additional seating in the aisle of the vehicle. However, such a device is not well suited as a portable device for adding one additional seating space to another single seat or chair. Further, such a device is not suitable for use with a single chair, as two such adjacent chairs are required for use of such a device. It is not contemplated in the -708 patent to use such a pivot-down seat arrangement with a single chair. Further, a spring means in such a device urges the seat to continuously assume a collapsed or upward-raised position, making it difficult to use in a hands-free manner, as one hand (and possible two) will have to be used to urge the pivoted seat portions down into their horizontal positions before being able to sit. Such an arrangement is inconvenient, particularly for the user who is holding a number of books and a cup of coffee, for example.

More portable solutions for providing adjacent seating to a chair are found in U.S. Pat. No. 5,647,632 to Fireman on Jul. 15, 1997, and in U.S. Pat. No. 6,773,059 to Volotsenko on Aug. 10, 2004. Both such devices provide for fold-out chair arrangements that are relatively portable, yet both include complicated configuration steps to set-up the adjacent seating. Both such devices include multiple different pieces dedicated to use with an adjacent chair, and both solutions require considerable additional floor space to be available. Neither of these prior art devices is particularly well-suited, therefore, for use in an office or home environment in front of a workstation, since both such devices require so much space for both use and assembly. While the –632 device folds down into a fairly attractive single chair, the –059 device is particularly unattractive when used as a single chair due to the fact that the additional hardware dedicated for use as its side chairs is stored behind the main chair in full view when not in use. U.S. Pat. No. 1,335,973 to Kesselman on Apr. 6, 1920 discloses a device similar in many ways to the –059 and –632 devices, and includes many of the same drawbacks.

U.S. Pat. No. 352,723 to Weeden on Nov. 16, 1886 discloses a convertible chair/bed arrangement that includes hinged leaves. Such hinged leaves, however, when in a lowered position, require a floor-engaging brace that folds down from the hinged leaf, and as such requires additional floor space to be used. Moreover, the hinges of such a device are not robust enough to support a person, and the device could easily fail structurally if a person were to apply his weight to the edge of such a folded-down leaf when the brace is inadvertently not properly positioned. The intended use of such a device is not to provide additional seating, but rather to convert a chair into a bed for a single person.

Finally, U.S. Pat. No. 961,169 to Shear on Jun. 14, 1910 provides a rather large wheeled chair that can be positioned where desired, and then folded out in such a way as to provide additional side-by-side seating. However, as with many of the prior art device, such an arrangement requires considerable floor space and includes complicated configuration steps to go from its single-user configuration to a multi-user configuration. From the side, moreover, such a device is cumbersome in appearance and is generally an inelegant solution.

Therefore, there is a need for a chair device that provides quick, additional seating for a person needing to sit next to another. Further, such additional seating would need to be provided in a stable and safe manner, and would not require considerable additional floor space. Such a needed device would provide an attractive ornamental appearance when in either single-user or multi-user configurations, and would not have a clumsy or inelegant appearance. Moreover, such a device would use a minimum of components to provide efficient use of materials, low cost of manufacture, and ease-of-use when configuring from single to multiple users. The present invention accomplishes these objectives.

SUMMARY OF THE INVENTION

The present device is a convertible chair that has pivotable side cushions for pivoting between a lowered position and a raised position. A frame includes a generally horizontal seat on the frame, as well as a pair of pivot supports each fixed to a respective side of the seat. Two sets of bars are included, each bar being pivotably supported at one end thereof to one of the pivot supports and pivotably supported thereby. Each set of bars are fixed to and support one of the side cushions. In the lowered position the side cushions each provide additional seating area, whereas in the raised position an outer edge of the each cushion may be used as an armrest for a person sitting in the chair.

The frame may further include at least four chair legs, a pedestal assembly, or the like for supporting the seat above a floor surface. In the preferred embodiment of the invention, a pedestal assembly includes a plurality of pedestal legs that each extend out beyond a vertical projection of the seat onto the floor surface. As such, the pedestal assembly provides a stable support for the frame, particularly when the side cushions are each in the lowered position and when two people are sitting on the larger seating area provided thereby.

The present invention facilitates quick, additional seating for a person needing to sit next to another in order to perform or learn a task. Further, such additional seating is stable and safe, and does not require additional floor space. The present invention has an attractive ornamental appearance when the side cushions are in either the lowered or raised positions, and does not have a clumsy or inelegant appearance, as do some of the prior art devices. Moreover, the side cushions are useful components of the invention when in both the raised or lowered positions, and thus in either position the side cushions take on a natural appearance of fitting their function. Other features and advantages of the present invention will become apparent from the following more detailed description, taken in conjunction with the accompanying drawings, which illustrate, by way of example, the principles of the invention.

DETAILED DESCRIPTION OF THE PREFERRED EMBODIMENT

Figure 2:
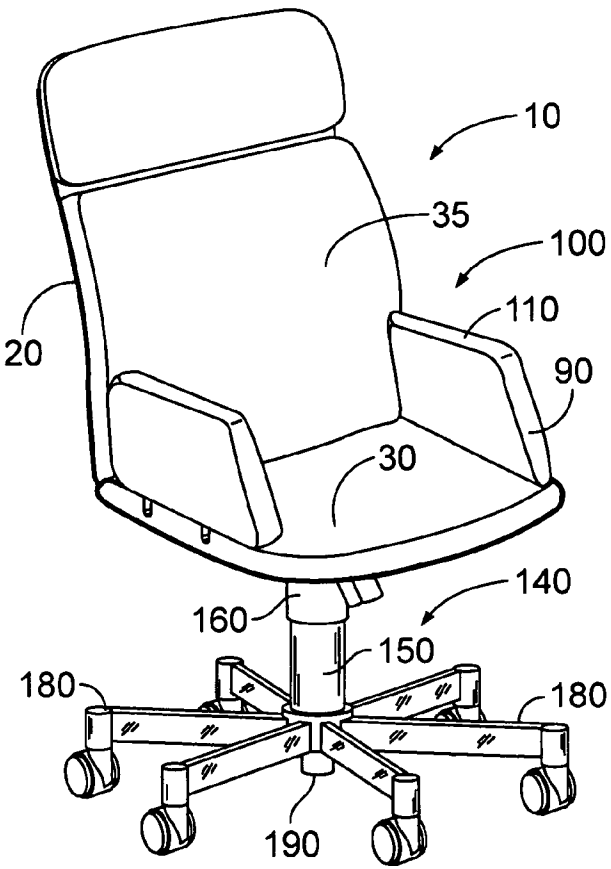
FIG. 2 is a perspective view of the invention, illustrating the convertible chair of the present invention with the side cushions in a raised position such that an outer edge of each cushion may be used as an armrest.
Figure 1:
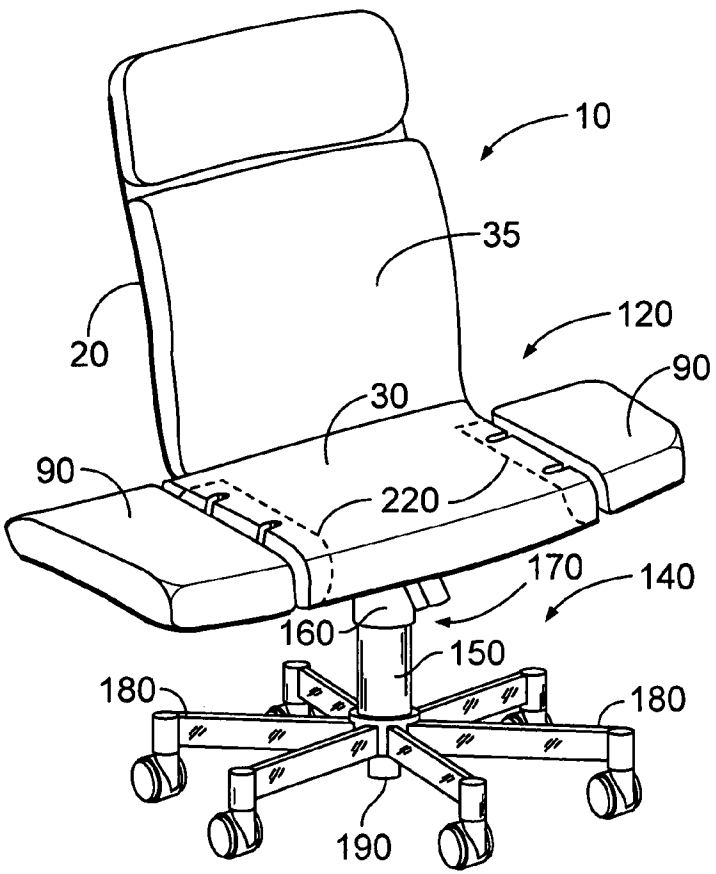
FIG. 1 is a perspective view of the invention, illustrating a convertible chair with side cushions in a lowered position to provide additional seating area.

The present invention is a convertible chair 10 that has pivotable side cushions 90 for pivoting between a lowered position 120 (FIG. 1) and a raised position (FIG. 2). A frame 20 includes a generally horizontal seat 30 on the frame 20, as well as a pair of pivot supports 40 each fixed to a respective side 50 of the seat 30. Two sets 60 of bars 70 are included, each bar 70 being pivotably supported at one end 80 thereof to one of the pivot supports 40 and pivotably supported thereby. Each set 60 of bars 70 are fixed to and support one of the side cushions 90. In the lowered position 120 the side cushions 90 each provide additional seating area, whereas in the raised position an outer edge 110 of the each cushion 90 may be used as an armrest for a person sitting in the chair (not shown).

The frame 20 is preferably made from a rigid metal bar stock material, but may also be made from a suitably strong and rigid plastic material. Likewise, the bars 70 are each preferably rigid metal bars, but may also be formed from a suitably strong and rigid plastic or fiberglass material. Each set 60 of bars 70 are preferably encased in one of the side cushions 90, so as not to be visible during routine use. The side cushions 90 preferably are made form a suitable fabric material surrounding a suitable padding material filler. The outer edge 110 of each side cushion 90 may be made from a more rigid material, such as a rubber or foam material, so as to provide a suitable armrest when the side cushion 90 is in the raised position 100 and serving as an armrest.

The frame 20 may further include at least four chair legs (not shown) for supporting the seat 30 above a floor surface 130. Preferably, however, the frame 20 further includes a pedestal assembly 140 for supporting the seat 30 above the floor surface 130. The pedestal assembly includes a central post 150 for engaging a seat support member 160 at a top end thereof, to which the seat 30 is fixed. The central post 150 is supported by a plurality of wheeled pedestal legs 180 at the bottom end 190 thereof, each leg 180 extending radially outward and generally perpendicularly from the longitudinal axis of the central post 150.

The pedestal assembly 140 is preferably made from a strong metal rod material, and may further include an air or liquid shock absorber means (not shown) for setting the height of the seat 30, or the tilt of a chair back 35. Such pedestal assemblies 140 are known in the art and thus are not fully described herein, as any suitable pedestal assembly 140 will suffice for the present invention. That notwithstanding, the seat support member 160 and the pedestal assembly 140 in general must be strong enough to support a potential double weight load when compared to counterparts thereof in prior art devices.

In the preferred embodiment, the plurality of pedestal legs 180 numbers six, and the legs 180 each extend out beyond a vertical projection 200 of the seat 30 onto the floor surface 130. As such, the pedestal assembly 140 provides a stable support for the frame 20, particularly when the side cushions 90 are each in the lowered position 120 and when two people are sitting on the larger seating area provided thereby (not shown). Preferably the pedestal legs do not extend beyond a vertical projection, at least laterally, when the additional seating is provided with the side cushions 90 in the lowered position 120. As such, less floor space 130 is required to support the additional seating than many of the prior art devices.

Figure 4:
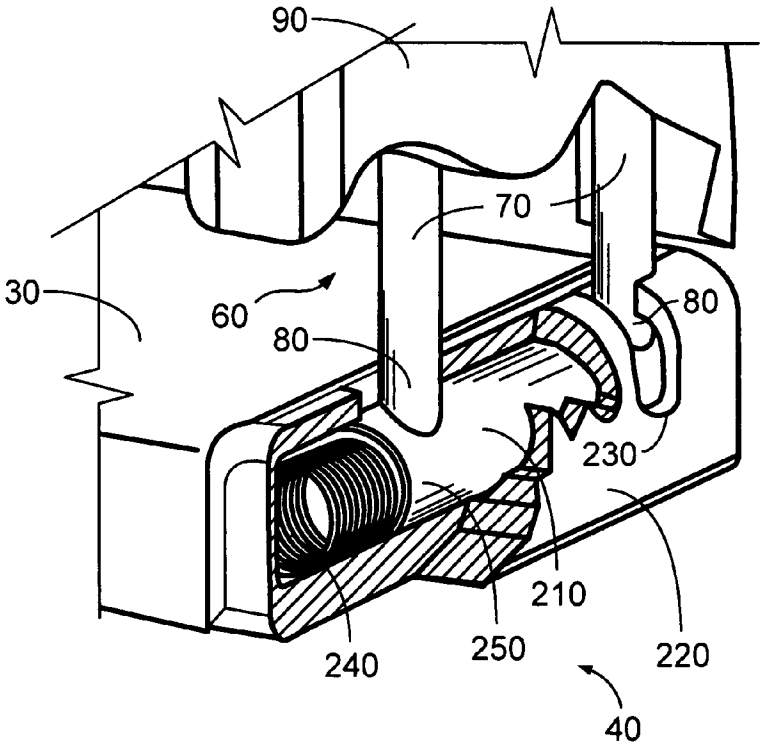
FIG. 4 is a close-up perspective view of the invention, taken generally along lines 4—4 of FIG. 3, illustrating a pivot enclosure in cut-away view.
Figure 3:
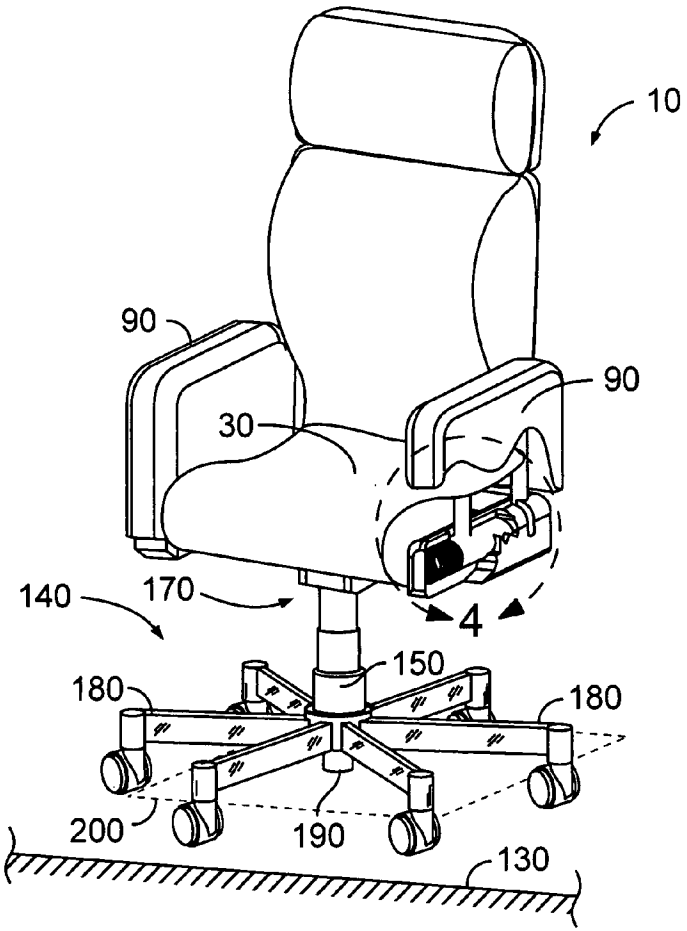
FIG. 3 is a perspective view of the invention, illustrating the convertible chair of the present invention with a pivot support shown in cut-away view.
Figure 6:
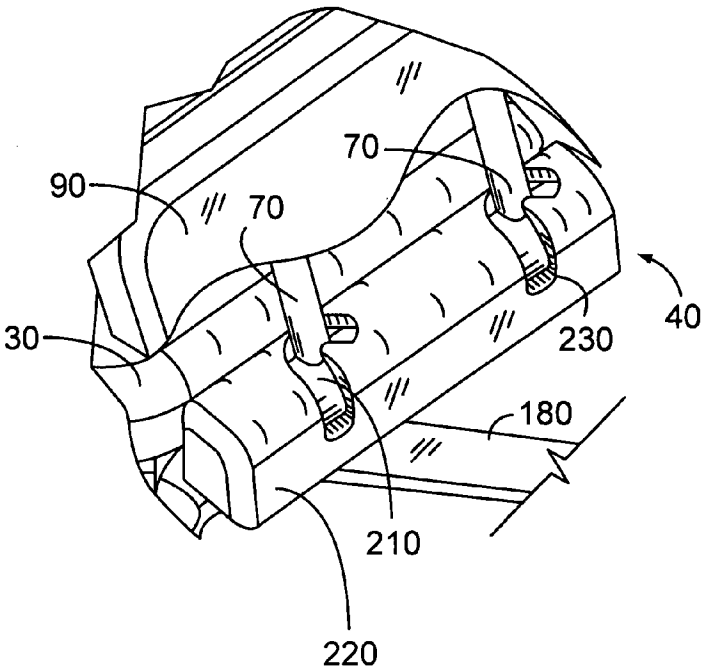
FIG. 6 is a close-up perspective view of the invention, taken generally along lines 6—6 of FIG. 5, illustrating the pivot support with the J-shaped aperture in more detail.
Figure 5:
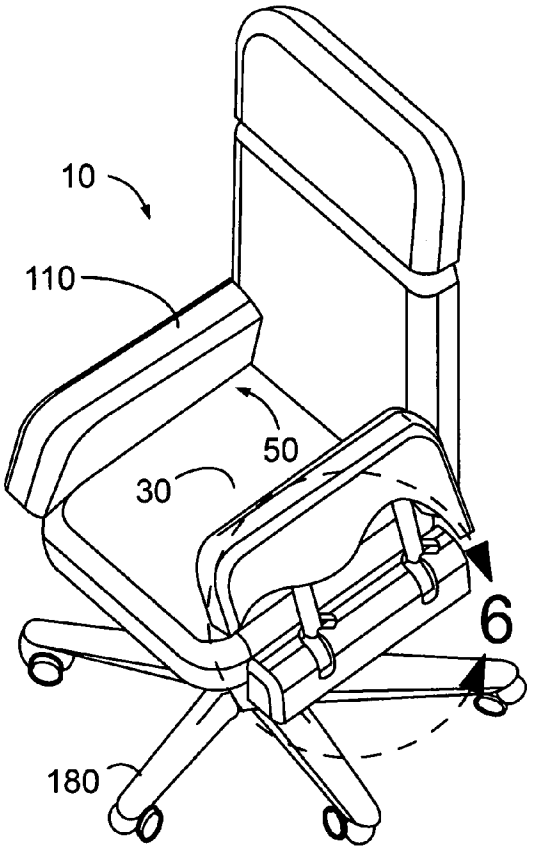
FIG. 5 is a perspective view of the invention, illustrating the convertible chair of the present invention with a pivot support having a J-shaped aperture therein.

Turning now to FIG. 4, each pivot support 40 preferably includes a pivot bar 210 laterally fixed within a pivot enclosure 220. The one end 80 of each bar 70 is fixed to a side of the pivot bar 210, such as by welding, and each bar 70 extends through an aperture 230 (FIG. 6) of the pivot enclosure 220. As such, each bar 70 is constrained to movement only within the aperture 230. A compression spring 240 is further included between each pivot enclosure 220 and a front end 250 of each pivot bar 210 (FIGS. 3 and 4). As a result, the side cushions 90 are each biased towards the rear of the chair 10.

The pivot bar 210 and the pivot enclosure 220 are each preferably made from a strong metal material, since when a person is at least partially sitting on a side cushion 90 there may be a considerable amount of torque force generated between the pivot bar 210 and the enclosure 220. As such, the pivot enclosure 220 must be made to withstand a considerable leveraged force therewithin, and the connection between the pivot bar 210 and each bar 70 must be strong enough to withstand such a force. As such, welding metal bars 70 to a metal pivot bar 210 provides sufficient strength. However, other materials and fixing methods could conceivably be used, such as molding the pivot bar 210 integral with the bars 70 from a suitably strong fiberglass or other resin material. Pivot enclosure 220 may be incorporated into the seat 30 (FIGS. 1 and 2), or may be mounted separate therefrom, as shown in FIGS. 3–6.

In one embodiment of the invention, illustrated in FIGS. 3 and 4, the aperture 230 is L-shaped. As a result, each side cushion 90 must be pushed in a forward direction, causing the pivot bar 210 to compress the compression spring 240, before each side cushion 90 may be lowered into the lowered position 120. In an alternate embodiment, illustrated in FIGS. 5 and 6, the aperture 230 is J-shaped, so that each side cushion 90 must be pushed in a forward and inward direction, then in a forward and outward direction, before it may be lowered into the lowered position 120. The compression spring 240, therefore, serves to bias the side cushions 90 towards the rear of the chair 10, thereby effectively locking the side cushions 90 in their set position until purposefully moved by the user. As such, the side cushions 90 are not easily inadvertently placed in an undesired position.

While a particular form of the invention has been illustrated and described, it will be apparent that various modifications can be made without departing from the spirit and scope of the invention. For example, any number of differing chair styles could be used and could incorporate the improvements described herein. Such an improved convertible chair would not necessarily have to be limited to a chair with a pedestal 140 or even four legs, provided the means for supporting the seat 30 was sufficiently strong to support two people sitting on the seat 30 and side cushions 90. Several chair styles are shown in the attached drawings to further support this view, and in fact, the convertible chair 10 of the present invention does not even need to have a chair back 35. Accordingly, it is not intended that the invention be limited, except as by the appended claims.

What is claimed is:

1. A convertible chair comprising:

a frame including a generally horizontal seat on the frame;

a pair of pivot supports, each fixed to a respective side of the seat and comprising a pivot bar laterally fixed within a pivot enclosure;

a pair of sets of bars, each bar thereof pivoted at one end to one of the pivot bars, pivotally supported thereby, and extending through an aperture in the pivot enclosure, each bar being constrained to movement only within the aperture; and a pair of side cushions, each supported by one set of bars;

whereby each side cushion may pivot between a raised position in which an outer edge of the cushion may be used as an armrest for a person sitting in the chair, and a lowered position in which the side cushion is generally co-planar with the seat to provide additional seating area.

2. The convertible chair of claim 1 further including a compression spring between each pivot enclosure and a front end of each pivot bar, and wherein each aperture is generally L-shaped, such that with each side cushion in the raised position, each side cushion must be pushed forward with enough force to compress the compression spring with the pivot bar before the side cushion may be pivoted to the lowered position.

3. The convertible chair of claim 1 further including a compression spring between each pivot enclosure and a front end of each pivot bar, and wherein each aperture is generally J-shaped, such that with each side cushion in the raised position, each side cushion must be pushed inward, forward and then outward with enough force to compress the compression spring with the pivot bar before the side cushion may be pivoted to the lowered position.

4. The convertible chair of claim 1 wherein with each side cushion in the lowered position, each pivot enclosure contacts the bars to prevent the side cushions from pivoting downward past the lowered position, each pivot enclosure being rigidly fixed to the frame and seat, and each pivot bar firmly fixed within the pivot enclosure to prevent either lateral or vertical movement thereof.

5. The convertible chair of claim 1 wherein the frame further includes at least four chair legs supporting the seat above a floor surface.

6. The convertible chair of claim 1 wherein the frame further includes a pedestal assembly supporting the seat above a floor surface, the pedestal assembly including a central post engaging a seat support member at a top end and a plurality of wheeled pedestal legs at a bottom end.

7. The convertible chair of claim 6 wherein the plurality of wheeled pedestal legs is six and the legs extend radially outward from the central post.

8. The convertible chair of claim 6 wherein the pedestal legs each extend radially outward from the central post past a vertical projection of the seat onto the floor surface.

9. A convertible chair comprising:

a frame including a generally horizontal seat on the frame, a pair of pivot supports, each fixed to a respective side of the seat, a set of bars, each bar pivoted at one end to one of the pivot supports and pivotally supported thereby, and a pair of side cushions, each supported by one set of bars, each set of bars being enclosed by one side cushion;

whereby each side cushion may pivot between a raised position in which an outer edge of the cushion may be used as an armrest for a person sitting in the chair, and a lowered position in which the side cushion is generally co-planar with the seat to provide additional seating area.

* * * * *